United States Patent [19]

Baron et al.

[11] 3,990,867

[45] Nov. 9, 1976

[54] PROCESS OF PRODUCING A HIGH-METHANE GAS INTERCHANGEABLE WITH NATURAL GAS

[75] Inventors: Gerhard Baron, Hofheim; Heinz Jockel, Klein-Gerau; Friedrich-Wilhelm Moller, Seulberg, all of Germany

[73] Assignee: Metallgesellschaft Aktiengesellschaft, Frankfurt am Main, Germany

[22] Filed: July 3, 1975

[21] Appl. No.: 593,088

Related U.S. Application Data

[63] Continuation of Ser. No. 376,043, July 2, 1973, abandoned.

[30] Foreign Application Priority Data

July 14, 1972 Germany ..... 2234654

[52] U.S. Cl. ..... 48/214 A

[51] Int. Cl.[2] ..... C10G 11/28; C01B 2/14

[58] Field of Search ..... 48/197 R, 213, 214, 48/215

[56] References Cited

UNITED STATES PATENTS

| | | | |
|---|---|---|---|
| 3,459,520 | 8/1969 | Percival | 48/214 |
| 3,475,160 | 10/1969 | Heinzelmann et al. | 48/213 |
| 3,898,057 | 8/1975 | Moller et al. | 48/214 A |

FOREIGN PATENTS OR APPLICATIONS

| | | | |
|---|---|---|---|
| 705,623 | 3/1954 | United Kingdom | |
| 820,257 | 9/1959 | United Kingdom | 48/214 |

*Primary Examiner*—S. Leon Bashore
*Assistant Examiner*—Peter F. Kratz
*Attorney, Agent, or Firm*—Burgess, Dinklage & Sprung

[57] ABSTRACT

High-methane, low-hydrogen gas, interchangeable with natural gas, is prepared by reacting hydrocarbons with steam in the presence of a nickel-based catalyst at elevated temperatures and pressures. The hydrocarbons and the steam are fed to the reaction in mixture with product gas from the process from which substantially all carbon dioxide has been removed.

4 Claims, 1 Drawing Figure

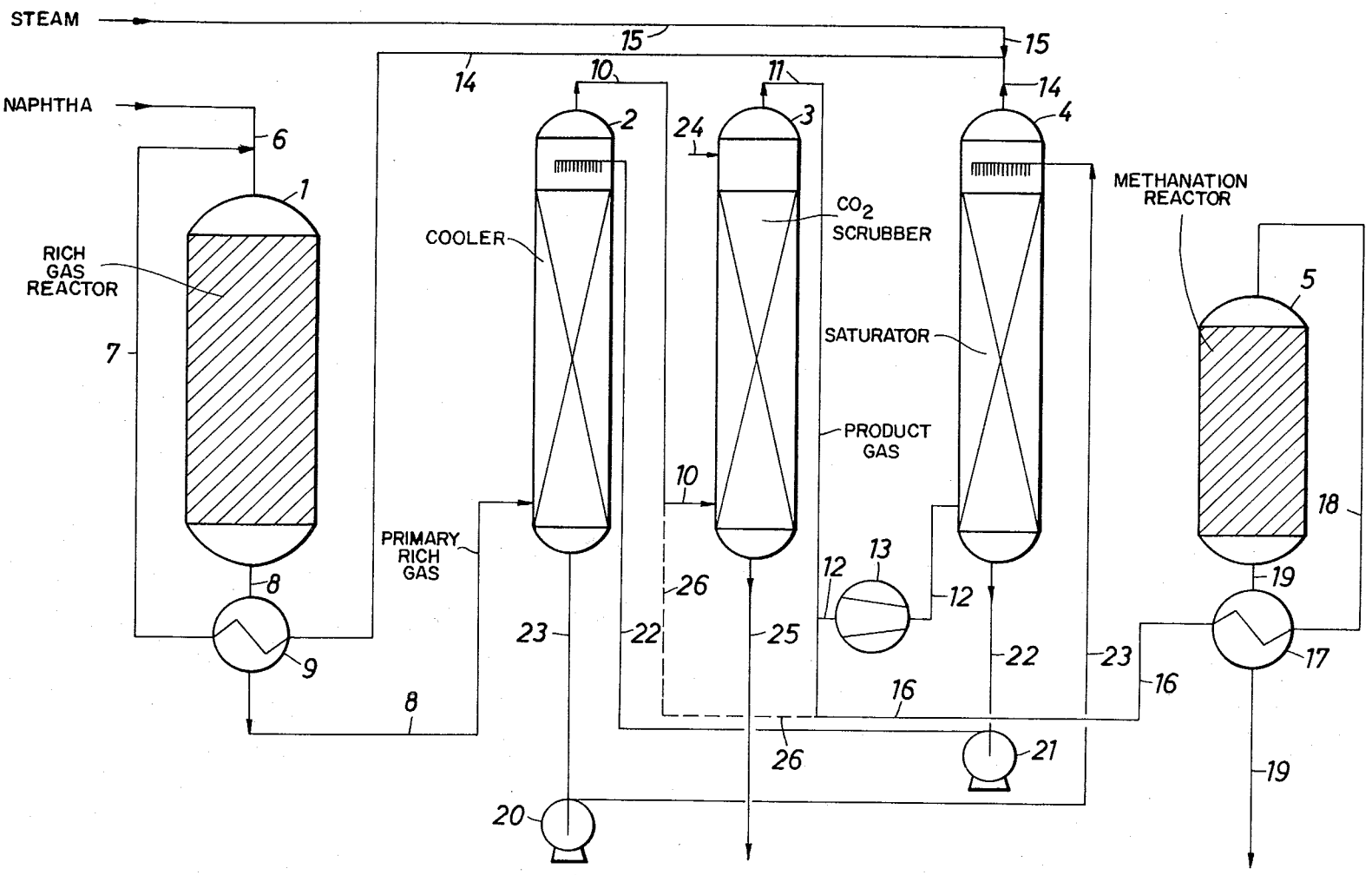
STEAM
NAPHTHA
RICH GAS REACTOR
COOLER
$CO_2$ SCRUBBER
SATURATOR
PRODUCT GAS
PRIMARY RICH GAS
METHANATION REACTOR
1
2
3
4
5
6
7
8
9
10
11
12
13
14
15
16
17
18
19
20
21
22
23
24
25
26

PROCESS OF PRODUCING A HIGH-METHANE GAS INTERCHANGEABLE WITH NATURAL GAS

This is a continuation, of application Ser. No. 376,043, filed July 2, 1973, now abandoned.

BACKGROUND

This invention relates to a process for producing synthetic natural gas wherein hydrocarbons and steam are reacted in the presence of a nickel-based catalyst at elevated temperatures and pressures in admixture with product gas from the process which is free of carbon dioxide.

Because industrial and communal fuel gas supply systems have been converted to the use of supply natural gas, the conversion of liquid hydrocarbons into methane has become an urgent problem.

Printed German Application 1,063,590 describes a process which serves to produce a rich gas having a high methane content. In the process, predominantly paraffinic hydrocarbons having an average C number of $C_4$ to $C_{10}$ together with 2–5 parts by weight of water vapor per part by weight of hydrocarbons are preheated to a temperature above 350° C. and are then cracked on a nickel-containing catalyst at a temperature in the range of 450–550° C. to form a high-methane gas, which can subsequently be completely reacted at temperatures below 400° C. to form a gas having an even higher methane content, or at temperatures above 550° C. to form a gas having high $H_2$ and CO contents.

It is known from Opened German Application 1,768,284 to produce high-purity methane by a catalytic hydrocracking of higher hydrocarbons in a process in which hydrogen is added to the hydrocarbon in an amount which is 90–150% of the amount theoretically required to eliminate all C-C bonds, and in which the exothermic effect is reduced and the reaction temperature is restricted to 400°–600° C. in that 0.5–3.5 kilograms water vapor are added per kilogram of the hydrocarbon feedstock. The resulting gas may consist almost entirely of methane and may contain only little hydrogen and carbon dioxide.

These two processes indicate the practical limits within which processes can be developed that serve to convert preferably liquid hydrocarbons into methane.

When it is taken into account that the hydrocracking of liquid hydrocarbons to form methane essentially consists in a saturation of the methylene groups, $CH_2$, with hydrogen, 1 mole of hydrogen is consumed per C atom. The amounts of hydrogen required to carry out this reaction on a commercial scale can actually be produced only by the known water-gas reactions. As is apparent from the sum formula $$C + 2\,H_2O = CO_2 + 2\,H_2,$$

1 mole carbon dioxide must be withdrawn as residual gas per 2 moles of hydrogen in the extreme case. It is apparent that 1 mole of carbon dioxide is obtained per 2 methylene groups to be hydrogenated. Besides, an extensive plant is required for the separate production of hydrogen.

In the production of methane by the cracking of liquid hydrocarbons with water vapor, the oxygen which has been introduced with the water must also be withdrawn from the reaction sequence.

This reaction sequence is a bundle of competing reactions, which in a temperature range of about 450° C. result in a state of equilibrium in which, based on dry gas, methane predominates and carbon dioxide is the second largest component. The remainder consists mainly of hydrogen and small amounts of carbon monoxide.

This reaction system involves the formation of carbon monoxide and hydrogen, the shift conversion of carbon monoxide and water vapor to form carbon dioxide and hydrogen, the hydrogenating cracking of the hydrocarbon feedstock and the hydrogenation of carbon monoxide to methane as well as the Boudouard reaction, in which elementary carbon and carbon dioxide are formed from carbon monoxide.

The Boudouard reaction is the most dangerous competing reaction because the deposition of elementary carbon clogs the catalyst layer and enforces a shutdown.

For this reason, additional process steps have been adopted in all processes of producing methane by a methanation of water gas with the object to minimize the concentration of carbon monoxide in the reaction mixture. In a multi-stage process, the hydrogen is carried through all stages whereas the carbon monoxide is divided into portions which are distributed among the stages. It is also known to recirculate methane-containing product gas through one or more stages and thus to introduce also carbon dioxide into the reaction so that the equilibrium of the Boudouard reaction is pushed to the side of the carbon monoxide.

Rich-gas processes of cracking liquid hydrocarbons with water vapor have been disclosed, e.g., in the abovementioned printed German Application 1,063,590, and it is desired in these processes to produce a cracked gas which contains as much methane as possible, to suppress the formation of carbon black by the Boudouard reaction, if possible, and to minimize the amount of water vapor which is to be added. The water vapor requirement for the reaction is mostly defined as the weight ratio of water vapor to hydrocarbons and will be referred to hereinafter as the water vapor ratio.

It is known that the presence of a surplus of water vapor in the cracking of liquid hydrocarbons with water vapor in the temperature range of 400°–600° C. reduces the tendency to form carbon black but opposes also the formation of methane, and that a lower reaction temperature and/or a higher reaction pressure promote the formation of methane at the expense of the formation of carbon oxides and hydrogen, that an addition of hydrogen to the feedstock mixture consisting of hydrocarbons and water vapor permits a reduction of the water vapor ratio, and by the hydrogenation of carbon oxides or a hydrogenating cracking of the hydrocarbons contributes to the exothermic formation of methane and opposes the formation of carbon black, and that the use of hydrocarbons having a low C number permits a lower water vapor ratio and lower reaction temperatures. To utilize these factors, the known rich-gas process has been modified in various ways, e.g., by a recirculation of product gas (U.S. Pat. No. 3,459,520), by an addition of hydrogen or hydrogen-containing gases (U.S. Pat. No. 3,415,634) or in that the process in carried out in a plurality of stages so that the water vapor is carried through all stages connected in series whereas the hydrocarbons are approximately uniformly distributed among these stages (U.S. Pat. No. 3,420,642).

In the production of high-methane gases by a cracking of liquid hydrocarbons with water vapor on nickel-containing catalysts with performance of individual or several ones of said process steps, the water vapor ratio must not be substantially below 1.6. In that case, the product gas still contains a surplus of water vapor, which is condensed as the gas is cooled. Rich gases thus produced contain on a dry basis at least 67% methane, the balance being carbon dioxide and hydrogen.

To convert such rich gases into a gas which is interchangeable with natural gas and consists mainly of methane and contains no carbon monoxide and only very little hydrogen, the carbon oxides are catalytically hydrogenated to methane so that the remaining hydrogen is consumed, and the still remaining carbon dioxide is scrubbed off.

In this process described in Opened German Specification 1,645,840 that methanation is carried out in two stages. In the stage the primary product consisting of the rich gas inclusive of its water vapor content, is passed over a methanation catalyst, then cooled to condense the water vapor, reheated and passed through the second methanation stage.

Opened German Specifications 1,922,181 and 1,922,182 disclose a process of producing a low-hydrogen, high-methane gas. In that process, a rich gas stage and a methanating stage are connected in series in direct succession, both reactors are indirectly cooled at their outlet end, and one reactant or both reactants, i.e., hydrocarbons and/or water, are introduced in liquid form as a direct-contact cooling fluid into the reaction mixture between the two reactors.

SUMMARY

It is an object of the invention to modify the known rich-gas process of producing high-methane gases by a reaction of liquid hydrocarbons and water vapor on nickel-containing catalysts at temperatures of 350° C to 600° C. such that the product gas which has been produced in a single-stage reactor and has been scrubbed to remove carbon dioxide contains at least 90% methane by volume and has a composition which meets most specifications for synthetic natural gas substitutes and that said gas can be subjected to a methanation in a single stage in which its hydrogen content is reduced to about 1% by volume, if this is required.

It has been found that the Boudouard reaction can be restricted if the proportion of carbon dioxide in the equilibrium of the reaction is reduced. This result is highly surprising because it would have had to be expected that the removal of one component of the Boudouard reaction product must promote the formation of the other, namely, carbon.

The reduction of the concentration of carbon dioxide in the equilibrium of the reaction is accomplished according to the invention in that at least part of the rich gas which has been produced is scrubbed to remove a major portion of the carbon dioxide, and that rich gas having a low carbon dioxide content is recycled and together with the feedstocks consisting of hydrocarbons and water vapor is fed into the rich-gas reactor.

DESCRIPTION OF THE DRAWING

The present invention will be more fully understood from the following description taken in conjunction with the accompanying drawing which is a schematic flow diagram of preferred apparatus for carrying out the process of the invention.

DESCRIPTION

The scrubbing to remove carbon dioxide is suitably carried out so that the change of the water vapor content of the rich gas primary product is minimized.

According to the invention, the rich gas primary product is cooled by sprinkling it with cold water before the carbon dioxide is scrubbed off. As a result of this sprinkling, the water vapor contained in the gas is condensed and the gas itself is cooled whereas the water is heated. The scrubbed rich gas is directly contacted with this heated water so that the rich gas is reheated and enriched with water vapor. Such cooler-saturators are known per se and its use ensures that the unreacted surplus water vapor which is still contained in the rich gas primary product is preserved at least in part for the rich-gas process because this water vapor is recycled into the reactor together with the scrubbed rich gas.

The carbon dioxide is suitably scrubbed off in known manner by means of a hot concentrated alkali carbonate solution at an absorption temperature which is near the atmospheric boiling point of the solution and under the process pressure. The laden absorbent is regenerated in the usual manner by flashing approximately to the ambient pressure and stripping with water vapor.

In the preferred embodiment of the invention, a recirculating compressor is used to recirculate gas from the rich-gas reactor in a cycle through the cooler, the carbon dioxide absorber and the saturator and back to the rich-gas reactor, water vapor is removed from the rich gas primary product in the cooler, carbon dioxide is removed from the rich gas primary product in the absorber, and water vapor is added in the saturator to the rich gas having a low carbon dioxide content.

The product gas is branched from said cycle between the carbon dioxide absorber and the saturator. The ratio of the branched-off product gas stream to the stream which is recycled through the saturator to the reactor inlet is 0.61–1.2. Because the properties of said gas meet the specifications which are applicable in some regions as regards composition, specific gravity and combustion properties (Wobbe number), the gas can be cooled and dried and can then be directly delivered to the distributing system.

If product specifications call for a lower hydrogen content, the gas can be passed directly through a methanation stage in which the hydrogen and the small residues of carbon monoxide and carbon dioxide are converted to form methane.

When it is desired to increase the carbon dioxide content of this product gas stream, either to correct the properties of the gas for direct delivery to a gas-distributing system, or to ensure that carbon dioxide in the amount required to consume the hydrogen is available in the subsequent methanation stage, a small amount of the rich gas primary product can be withdrawn between the gas cooler and the carbon dioxide absorber and admixed to the branched-off product gas stream.

In the process according to the invention, the ratio of live steam to hydrocarbon reacted may be reduced to values substantially under 1, e.g., 0.5–0.9 kg live steam per kg of hydrocarbon reacted.

The reduction of the carbon dioxide concentration in the equilibrium of the reaction by which the rich gas is produced restricts the Boudouard reaction because the carbon monoxide concentration enters as a squared term into the equilibrium constant of the Boudouard reaction whereas it is only a linear term in the equilibrium constant of the water-gas reaction.

The removal of carbon dioxide from the product gas stream which is recirculated through the rich-gas reactor promotes the shift conversion reaction much more so that the latter results in a formation of more hydrogen.

Besides, the use of the cool-saturator system before and after the absorption of carbon dioxide ensures that the water vapor contained in the rich gas primary product is largely preserved in the cycle. In that case, less water vapor must be condensed when the product gas is cooled so that less live steam must be introduced into the rich-gas reactor.

The reduction of the live steam requirement and the increase of the margin of safety from the concentration range in which the Boudouard reaction is possible more than offset the expenditure which is involved in the cooler-saturator system. Said expenditure consists substantially of a capital expenditure and hardly involves operating expenses.

A flow scheme of a plant for carrying out the process according to the invention is shown by way of example in the drawing.

The plant consists essentially of the rich-gas reactor 1, the trickling cooler 2, the absorption tower 3 for scrubbing off the carbon dioxide, the saturator 4, and the methanation reactor 5.

The hydrocarbons to be reacted, e.g., a gasoline of the naphtha range, are supplied in the form of vapor to the plant through the conduit 6. Because these hydrocarbons have been subjected, for the sake of precaution, to a hydrogenating desulfurization in a known and conventional manner in a unit which is not shown, the vapor of the hydrocarbons to be reacted may contain some hydrogen. The steam for the reaction and product gas having a low carbon-dioxide content are supplied through the conduit 7 and in the conduit 6 are mixed with the hydrocarbon vapor.

The reaction product is conducted from the reactor 1 through a conduit 8 and a heat exchanger 9 to the trickling cooler 2, in which the reaction product is cooled in contact with water, which trickles down over packing particles or internal fixtures.

The cooled gas is passed from the top of the trickling cooler 2 through the conduit 10 to the absorption tower 3 and rises in the latter and is scrubbed therein with carbon dioxide-absorbing liquid, preferably a hot concentrated potassium carbonate solution which trickles down. A rich gas from which substantially all carbon dioxide has been scrubbed off is withdrawn from the top of the absorption tower through the conduit 11. A branch stream is conducted through the conduit 12 and by the recirculating compressor 13 is delivered into the sump of the saturator 4. This gas is contacted in the saturator with trickling water which in the cooler 2 has been heated in contact with the hot rich gas which still contains carbon dioxide. The gas is thus heated and enriched with water vapor in the saturator and returns through the conduit 14, and through the heat exchanger 9 and the conduits 7 and 6 to the inlet of the reactor 1. The required live steam is supplied through conduit 15 to conduit 14 to be admixed therein.

Tht branch stream of the scrubbed gas which is not recirculated through the reactor, cooler, absorption tower, and saturator, is branched off in the conduit 16 and in a manner not shown can be withdrawn through a final cooler, in which residual water vapor is condensed. The gas can then be delivered for use.

In the embodiment shown by way of example, this branch stream is conducted through the conduit 16 to a heat exchanger 17 and from the latter through the conduit 18 into the methanation reactor 5, in which residual hydrogen and carbon dioxide are hydrogenated in known manner to form methane. Almost pure methane is delivered from the methanation reaction 5 through conduit 19, the heat exchanger 17, and a final cooler, not shown, for use, e.g., in a gas-distributing system.

By means of the pumps 20 and 21 in the conduits 22 and 23, water is recirculated through the cooler 2 and saturator 4. Such cooler saturator system are known per se, particularly in conjunction with reactors for the shift conversion of carbon monoxide and water vapor to produce carbon monoxide and hydrogen. In conjunction with a purification of gas, such systems have been utilized in the desulfurization of hot saturated fuel gases whose water vapor content should be preserved as far as possible.

The absorbent solution is supplied through the conduit 24 to the top of the absorption tower 3, in which carbon dioxide is scrubbed from the cooled rich gas. The absorbent solution which is laden with carbon dioxide is conducted from the sump through a conduit 25 to a regenerator, which is known per se and is not shown, and after the absorbed carbon dioxide has been removed from the absorbent solution the same returns through the conduit 24 to the absorption tower 3. If the carbon dioxide concentration which remains in the scrubbed gas is not sufficient for consuming in the methanation unit to a large extent the hydrogen contained in the product gas stream which has been branched off through the conduit 16, a small amount of gas which still contains carbon dioxide can be diverted from the conduit 10 before the absorption tower 3 and be conducted through the conduit 26 indicated by a dotted line and admixed to the product gas flowing through the conduit 16 to the methanation.

The following examples are intended to illustrate the invention without limiting same in any manner

EXAMPLE 1

A reactor which contains 100 liters catalyst is fed per hour with 100 kilograms gasoline boiling in the range of 40°–185° c. and 206 standard cubic meters of a gas which has been withdrawn from the process. On a dry basis, this gas is composed of $CO_2$ 1% by volume
CO 0.2% by volume
$H_2$ 5.2% by volume
$CH_4$ 93.6% by volume and also contains 159 kilograms water vapor. The catalyst which is employed contains 40% by weight of nickel on a magnesium silicate support. (Catalyst weight = 100). Before entering the reactor, the mixture of gasoline, gas, and water vapor is heated to a temperature of 370° C.

372 standard cubic meters gas and 96 kilograms water vapor at a temperature of 450° C. are withdrawn per hour from the reactor. On a dry basis, the gas is composed of $CO_2$ 11.1% by volume
CO 0.2% by volume
$H_2$ 4.6% by volume
$CH_4$ 84.1% by volume This gas-vapor mixture is first indirectly cooled to 300° C. and is then introduced into a packed tower which is fed at the top with 763 kilograms water. The gas leaves the tower at its top at a temperature of 150° C. and still contains 0.1 kilogram water vapor per standard cubic meter. The gas is further indirectly cooled to a temperature of 120°40 C. and is then fed to an absorption tower in which the gas is scrubbed in known manner with a hot aqueous concentrated solution of potassium carbonate to remove the carbon dioxide. The gas withdrawn from the top of the absorption tower is at a temperature of 101° C. and composed of:

$CO_2$ 1.0% by volume
CO 0.2% by volume
$H_2$ 5.2% by volume
$CH_4$ 93.6% by volume.

This gas is withdrawn as a product gas at a rate of 127 standard cubic meters per hour.

The remaining 206 standard cubic meters per hour are contacted in an additional packed column with hot water, which has been withdrawn at a temperature of 210° C. from the first packed column and is fed to the second packed column at its top. Water vapor at a rate of 65 kilograms per hour is fed together with this water or a point which is slightly below the point where the water is fed.

The gas which leaves the second packed column has a water vapor content of 0.771 kilograms per standard cubic meter, corresponding to a rate of 159 kilograms water vapor per hour. This gas-vapor mixture is mixed with the vapor of the gasoline feedstock and is further heated and then fed into the reactor.

The product gas which is branched off between the absorption tower and the second packed column at a rate of 127 standard cubic meters per hour is cooled and delivered to a distributing system.

A mean pressure of about 45 kilograms per square centimeter (absolute pressure) prevails at the reactor inlet, and the lowest pressure prevails at the junction where the product gas is branched off behind the absorption tower.

The gas which is recycled through the second packed column to the reactor is pressurized by a compressor to the higher inlet pressure of the reactor.

EXAMPLE 2

The product gas which has been produced in accordance with Example 1 is treated so that most of the hydrogen contained therein is removed by being reacted with the carbon dioxide contained in the gas so that methane is formed.

The product gas branched off at a rate of 127 standard cubic meters per hour is heated to 310° C. and conducted through a methanation reactor, which contains 70 liters of a methanation catalyst. This catalyst contains metallic nickel on an alumina support. The nickel content amounts to 35% by weight of the total weight of the catalyst.

A gas is withdrawn from this reactor at a rate of 122 standard cubic meters per hour and has the following composition:

$CO_2$ 0.1% by volume
CO - % by volume
$H_2$ 1.1% by volume
$CH_4$ 98.8% by volume.

The heat of formation of methane has raised the temperature of the gas to 350° C.

What is claimed is:

1. Process for producing high-methane, low-hydrogen gas interchangeable with natural gas which comprises:

a. reacting a reaction mixture containing liquid hydrocarbons, live steam and recycled methane-rich gas containing water vapor and at least 90% methane by volume on a dry basis on a nickel containing catalyst at temperatures of 350°–600° C and under elevated pressure to produce a rich gas primary product containing carbon dioxide, the ratio of live steam to hydrocarbons in said reaction mixture being less than 1;

b. cooling said rich gas primary product in a cooling zone by sprinkling it with cold water from the saturation zone of step (e) thus heating said water;

c. removing substantially all of the carbon dioxide from at least part of said rich gas primary product cooled in step (b);

d. dividing said product gas from (c) into a first partial stream and a second partial stream, the ratio of said first partial stream to said second partial stream being 0.61–1.2;

e. heating said second partial stream and enriching it with water vapor by contacting it in a saturation zone with heated trickling water from the cooling zone of step (b); and f. combining said second partial stream from step (e) with said liquid hydrocarbons in step (a) as said recycled methane-rich gas.

2. Process of claim 1 wherein 0.5–0.9 kg of live steam is used per kg of hydrocarbons reacted.

3. Process of claim 1 wherein the first partial stream is passed through a methanation stage.

4. Process of claim 1 wherein a portion of the rich gas primary product from step (b) is branched off before removing carbon dioxide and is added to said first partial stream.

* * * * *